US008125420B2

(12) United States Patent
Arkhipov et al.

(10) Patent No.: US 8,125,420 B2
(45) **Date of Patent: *Feb. 28, 2012**

(54) ORGANIC LIGHT-EMITTING DISPLAY DEVICE AND METHOD OF DRIVING THE SAME

(75) Inventors: Alexander Arkhipov, Suwon-si (KR); Kyong-Tae Park, Suwon-si (KR)

(73) Assignee: Samsung Electronics Co., Ltd (KR)

( * ) Notice: Subject to any disclaimer, the term of this patent is extended or adjusted under 35 U.S.C. 154(b) by 649 days.

This patent is subject to a terminal disclaimer.

(21) Appl. No.: 12/182,051

(22) Filed: Jul. 29, 2008

(65) Prior Publication Data

US 2009/0033602 A1 Feb. 5, 2009

(30) Foreign Application Priority Data

Jul. 30, 2007 (KR) ..... 10-2007-0076136

(51) Int. Cl.
*G09G 3/30* (2006.01)

(52) U.S. Cl. ..... 345/77

(58) Field of Classification Search ..... 345/76–84, 345/89, 60–65, 204–215, 690–699; 315/169.1–169.4
See application file for complete search history.

(56) References Cited

U.S. PATENT DOCUMENTS

| | | | | |
|---|---|---|---|---|
| 6,960,889 | B2 * | 11/2005 | Park et al. | 315/169.2 |
| 2005/0099367 | A1 * | 5/2005 | Kang et al. | 345/74.1 |
| 2005/0280611 | A1 * | 12/2005 | Abe et al. | 345/74.1 |
| 2005/0285828 | A1 * | 12/2005 | Inoue et al. | 345/76 |
| 2006/0202934 | A1 * | 9/2006 | Shin et al. | 345/95 |
| 2007/0206031 | A1 * | 9/2007 | Yamada | 345/690 |

* cited by examiner

*Primary Examiner* — Amare Mengistu
*Assistant Examiner* — Jonathan King
(74) *Attorney, Agent, or Firm* — Innovation Counsel LLP

(57) ABSTRACT

An organic light-emitting display for improving an aperture ratio and increasing lifespan includes an organic light-emitting display panel in which pixel cells are formed, a gray-scale converter configured to convert a gray-scale of a pixel data signal by multiplying the pixel data signal which drives the pixel cells by a scale parameter, and a scale parameter generator configured to generate the scale parameter, wherein the scale parameter generator generates a scale parameter of a present frame by increasing or decreasing a scale parameter of a previous frame in proportion to a current difference obtained by subtracting a reference current value from a total current value of the pixel data signal which is gray-scale converted from the previous frame.

18 Claims, 7 Drawing Sheets

ORGANIC LIGHT-EMITTING DISPLAY DEVICE AND METHOD OF DRIVING THE SAME

This application claims priority under 35 U.S.C. §119 to Korean Patent Application No. 10-2007-0076136, filed on Jul. 30, 2007 in the Korean Intellectual Property Office (KIPO), the contents of which is incorporated herein by reference in its entirety.

BACKGROUND OF THE INVENTION

1. Field of the Invention

The present disclosure relates to an organic light-emitting display device and a method of driving the same, and more particularly, to an organic light-emitting display device whose aperture ratio is improved and life span is extended, and a method of driving the same.

2. Description of the Related Art

An organic light-emitting display ("OLED") device is a flat-type display device using an electroluminescent phenomenon of an organic material. An organic electroluminescent material is injected between an anode electrode and a cathode electrode of the OLED device and an electric current is applied therebetween. Electrons and holes are transferred to the organic electroluminescent material and recombined so that light is emitted by recombination energy of the electrons and holes.

Unlike a non-emissive display device such as a liquid crystal display ("LCD") device, the OLED device may be made small and lightweight as it does not require a light source. The OLED device is driven with low electrical power. Accordingly, energy efficiency is high. The OLED has the advantage of high brightness and response speed and is employed in various portable electronic devices as well as large-scale televisions.

The OLED device is an emissive display device requiring a signal line for driving an OLED panel and a current-supply line for supplying a current for light emission. The current-supply line may undergo a voltage drop caused by supplied current and internal resistance. As the current supplied is high the amount of voltage drop increases correspondingly. In order to resolve these problems the current-supply line needs to have a relatively large width. However, the large line width of the current-supply line may reduce an aperture ratio. In order to compensate for a reduced aperture ratio a high brightness light is emitted, which reduces the lifespan of the OLED panel.

When a relatively narrow width current-supply line is formed to improve the aperture ratio of the organic light-emitting display panel, the amount of electric current varies greatly according to a big luminance difference in each frame. As such, the amount of electric current applied to the current-supply line is drastically increased, causing a short circuit in the current-supply line.

BRIEF SUMMARY OF THE INVENTION

One embodiment provides an organic light-emitting display device that is capable of improving the aperture ratio and extending the life span by restricting an electric current supplied to an OLED panel to have a value less than a constant value, so that the line width of the current-supply line may be decreased, and a method of driving the same.

Another embodiment provides an organic light-emitting display device that enables high-speed limitation to an electric current where a difference in brightness is large at each frame of the OLED panel.

One exemplary embodiment provides an organic light-emitting display device that includes an organic light-emitting display panel in which pixel cells are formed; a gray-scale converter configured to convert a gray-scale of a pixel data signal by multiplying the pixel data signal that drives the pixel cells by a scale parameter; and a scale parameter generator configured to generate the scale parameter. The scale parameter generator generates a scale parameter of a present frame by increasing or decreasing a scale parameter of a previous frame in proportion to a current difference obtained by subtracting a reference current value from a total current value of the pixel data signal that is gray-scale converted from the previous frame.

Another exemplary embodiment provides a method for driving an organic light-emitting display device. The method includes calculating a current difference by subtracting a reference current value from a total current value of pixel data signals supplied to an organic light-emitting display panel of a previous frame; generating a scale parameter of a present frame by increasing and decreasing a scale parameter multiplied by the pixel data signals supplied from the previous frame in proportion to the current difference; and multiplying the scale parameter by the pixel data signals of the present frame.

BRIEF DESCRIPTION OF THE DRAWINGS

The above and/or other aspects, features and advantages will become more apparent from the following detailed description when taken in conjunction with the accompanying drawings, in which.

DETAILED DESCRIPTION OF THE INVENTION

Hereinafter, various embodiments will be described in detail with reference to the accompanying drawings.

Figure 1:
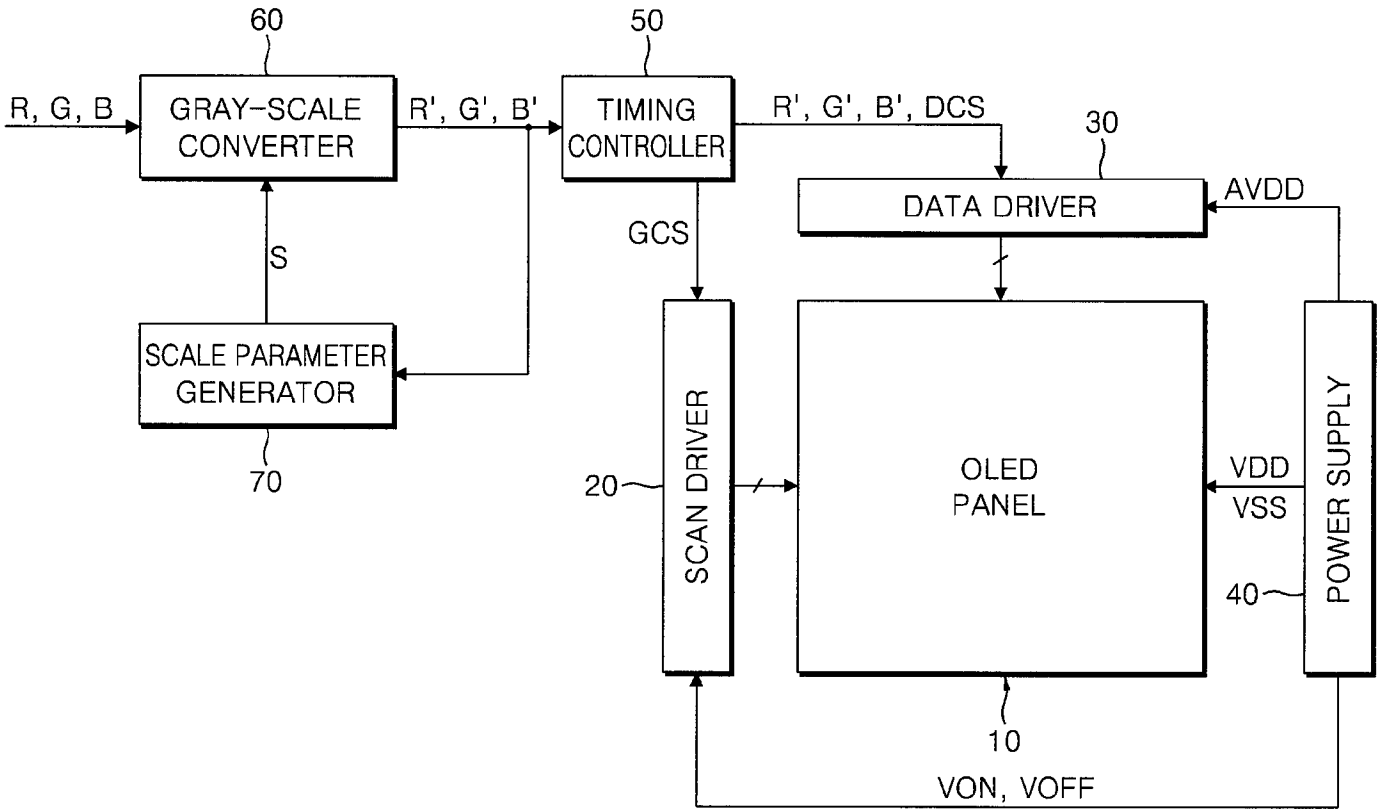
FIG. 1 is a block diagram illustrating an OLED device according to an exemplary embodiment.
Figure 2:
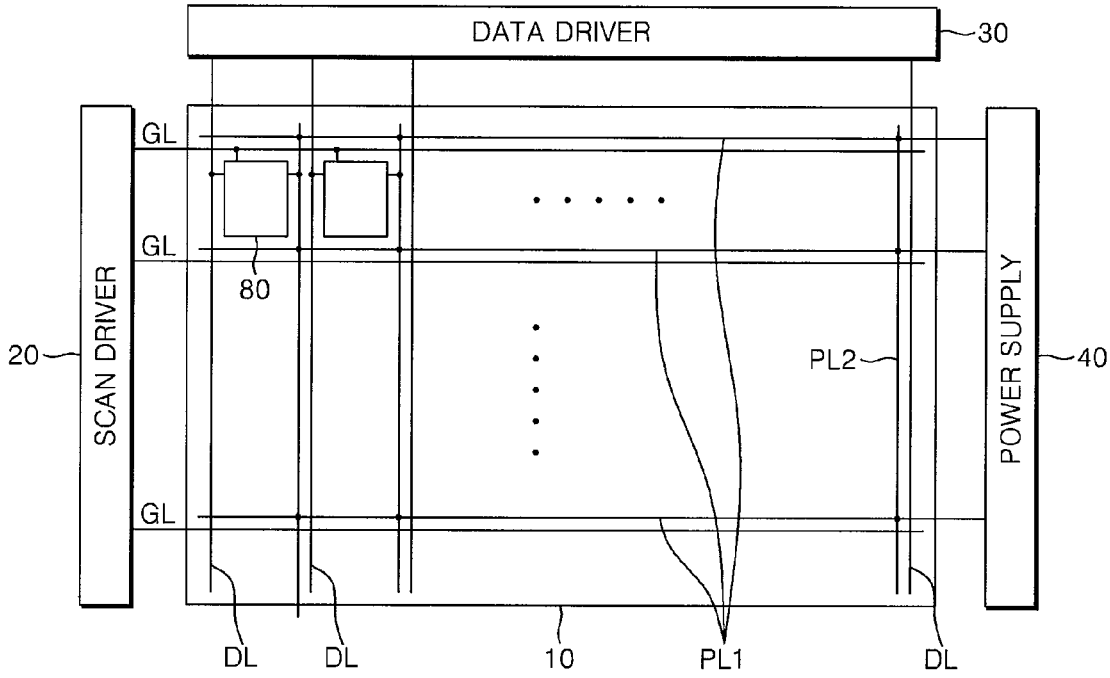
FIG. 2 is a plan view illustrating an OLED panel of the OLED device of FIG. 1 according to an exemplary embodiment.
Figure 3:
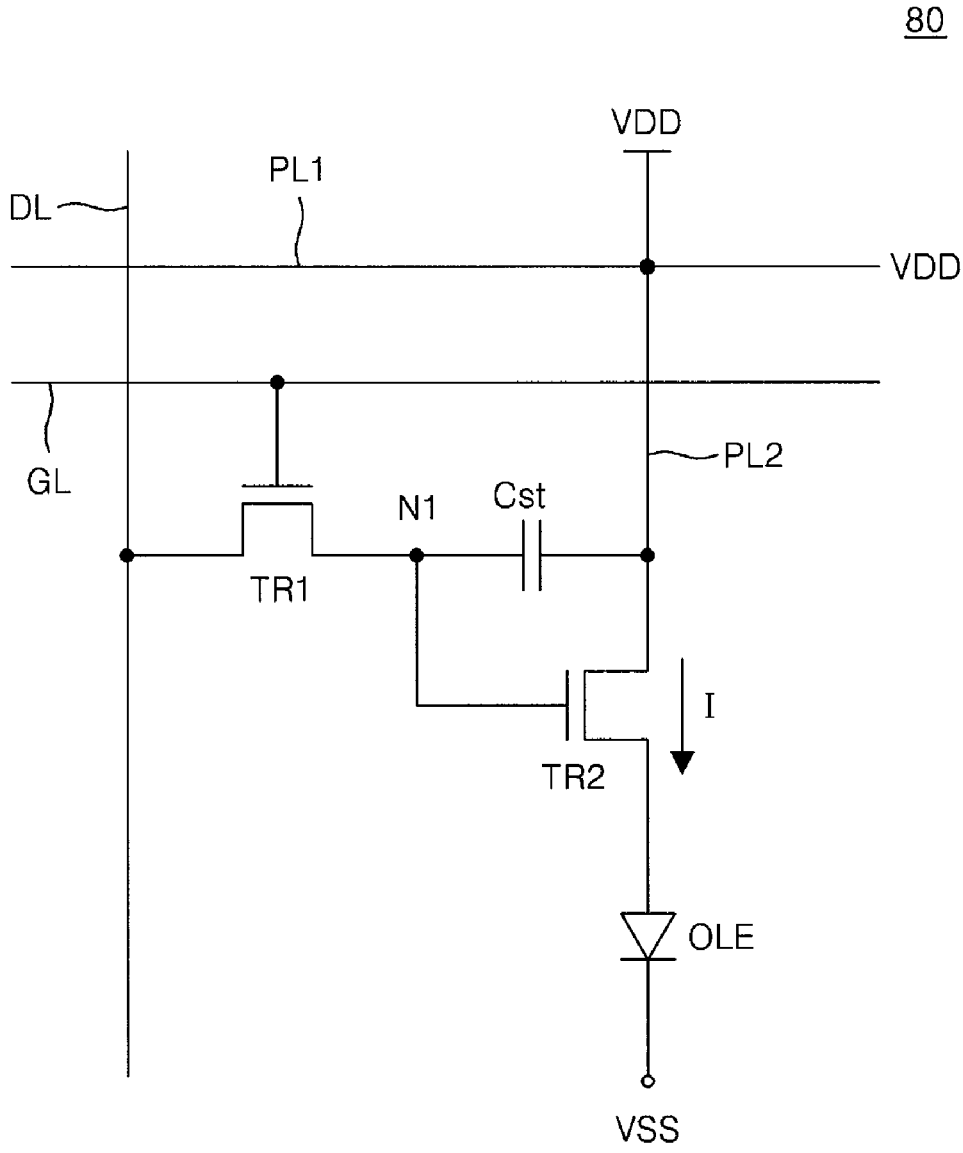
FIG. 3 is a circuit diagram illustrating a pixel cell of the OLED panel of FIG. 2.

FIG. 1 is a block diagram illustrating an OLED device according to an exemplary embodiment, FIG. 2 is a plan view illustrating an OLED panel of the OLED device of FIG. 1, and FIG. 3 is a circuit diagram illustrating a pixel cell of the OLED device of FIG. 2.

Referring to FIGS. 1 through 3, an OLED device according to an exemplary embodiment includes an OLED panel 10, a scan driver 20, a data driver 30, a power supply 40, a gray-scale converter 60, a timing controller 50, and a scale parameter generator 70.

The power supply 40 supplies a gate-on voltage VON and a gate-off voltage VOFF to the scan driver 20. The power supply 40 supplies an analog driving voltage AVDD to the data driver 30 and supplies a power signal VDD to an organic light-emitting diode of the OLED panel 10. The magnitude of current from the power supply 40 ranges from approximately 1.8 A to approximately 10.2 A in consideration of the line width of each of first and second current-supply lines PL1 and PL2. The power supply 40 may control the amount of current according to a reference current value preset by the scale parameter generator 70 that restricts total power or current consumption of the OLED panel 10.

The scan driver 20 sequentially supplies a scan signal to a gate line GL to turn on first transistors TR1 connected to the gate line GL. The scan driver 20 has one side connected to the OLED panel 10 and the other side mounted on a film connected to a printed circuit board. The scan driver 20 may be integrated in the OLED panel 10.

The data driver 30 converts pixel data signals R', G' and B' supplied from the timing controller 50 into analog data voltages and supplies the voltages to a data line DL.

The timing controller 50 supplies a gate control signal GCS to the scan driver 20 to control output timing of the scan signal supplied through the gate line GL. Further, the timing controller 50 supplies a data control signal DCS to the data driver 30 to control the data driver 30 so that the data driver supplies a data voltage to the data line DL whenever the scan signal is supplied from the scan driver 20. The timing controller 50 supplies pixel data signals R', G' and B' converted by the gray-scale converter 60 to the data driver 30.

The gray-scale converter 60 multiplies the pixel data signals R, G and B inputted from an external unit (not shown) by a scale parameter S supplied from the scale parameter generator 70 and supplies the resultant signals to the timing controller 50. More specifically, the gray-scale converter 60 multiplies the pixel data signals R, G and B of a present frame by the scale parameter S generated by a pixel data signal of a previous frame to convert the gray-scales of the pixel data signals of the present frame. That is, the gray-scale converter 60 changes gray-scale information of a prescribed frame by multiplying the pixel data signals R, G and B of red, green and blue in the prescribed frame by the scale parameter S, to limit the amount of current consumption in the organic light-emitting diode.

When the pixel data signals R, G and B of a present frame are input, the scale parameter generator 70 changes the scale parameter S' of a previous frame generated from previous frame data and supplies the changed scale parameter to the gray-scale converter 60. A detailed description of the scale parameter generator 70 will be described later.

The OLED panel 10 includes, as shown in FIG. 2, gate lines GL, data lines DL crossing the gate lines GL, pixel cells 80 arranged relative to the intersections of the gate lines GL and the data lines DL, and first and second current-supply lines PL1 and PL2 that supply current to the pixel cells 80.

The pixel cell 80 includes, as shown in FIG. 3, an organic light-emitting diode OLE, first and second transistors TR1 and TR2 that control the organic light-emitting diode OLE, and a storage capacitor Cst that charges a data voltage supplied to the first transistor TR1.

The gate line GL applies a scan signal supplied from the scan driver 20 to the pixel cell 80.

The data line DL is formed to cross the gate line GL and applies a data voltage supplied from the data driver 30 to the first transistor TR1.

The first transistor TR1 is turned on in response to the scan signal supplied to the gate line GL to supply the data voltage supplied from the data line DL to a first node N1. The storage capacitor Cst charges a data voltage supplied to the first node N1. When the first transistor TR1 is turned off, the data voltage charged in the storage capacitor Cst is supplied to a gate electrode of the second transistor TR2, thereby turning on the second transistor TR2. The second transistor TR2 is in an ON state until the data voltage charged in the storage capacitor Cst is discharged to the level of a power signal VDD supplied from the power supply 40 and supplies a power signal VDD supplied from the first and second current-supply lines PL1 and PL2 to the organic light-emitting diode OLE. In an exemplary embodiment, the first and second transistors TR1 and TR2 may be formed of any one of N-type and P-type thin film transistors.

The organic light-emitting diode OLE includes an anode, a cathode, and an organic light-emitting layer (not shown) formed between the anode and the cathode. According to an exemplary embodiment, the anode is formed of an opaque conductive material or an opaque metal on a substrate of the OLED panel 10. The cathode is formed, opposite to the anode, of a transparent conductive material. The organic light-emitting layer includes light-emitting materials to generate red light, green light and blue light. The organic light-emitting layer further includes a hole injection layer (not shown), a hole transport layer (not shown), a light-emitting layer (not shown), an electron transport layer (not shown), and an electron injection layer (not shown) that are sequentially stacked over the anode. The organic light-emitting diode OLE generates light such that the cathode supplies electrons to the light-emitting layer through the electron injection layer and the electron transport layer, the anode supplies holes to the light-emitting layer through the hole injection layer and the hole transport layer, and the electrons and the holes are recombined in the light-emitting layer to emit light. The anode of the organic light-emitting diode OLE is connected to an output terminal of the second transistor TR2, and the cathode of the organic light-emitting diode OLE is connected to a ground VSS or a power signal terminal VSS that has a voltage less than that supplied to the anode. The organic light-emitting diode OLE is driven by a current 'I' controlled by the second transistor TR2 through a voltage difference between the gate and source of the second transistor TR2 according to a data voltage supplied from the first transistor TR1.

The first current-supply line PL1 is arranged parallel with the gate line GL, and the second current-supply line PL2 is arranged parallel with the data line DL. That is, the first and second current-supply lines PL1 and PL2 are formed to cross each other and are electrically connected to each other at crossing points. The pixel cell 80 is supplied with an electrical current through a plurality of current-supply paths such as the first and second current-supply lines PL1 and PL2. Therefore, since the number of current-supply paths through which a current passes is increased, even if the line width of each of the first and second current-supply lines PL1 and PL2 is reduced, a voltage drop which may occur in the first and second current-supply lines PL1 and PL2 can be prevented.

In an exemplary embodiment, each of the first and second current-supply lines PL1 and PL2 includes a line width of approximately 12 μm to 67 μm. When each of the first and second current-supply lines PL1 and PL2 includes a line width of approximately 12 μm, a current supplied from the power supply 40 is restricted to approximately 1.8 A, whereas when each of the first and second current-supply lines PL1 and PL2 includes a line width of approximately 67 μm, a current supplied from the power supply 40 is restricted to approximately 10.2 A. Therefore, the line width of each of the first and second current-supply lines PL1 an PL2 should be less than approximately 67 μm in order to ensure the aperture ratio for the OLED panel 10. Moreover, considering the minimum current amount to drive any pixel cell 80, the line width of each of the first and second current-supply lines PL1 and PL2 should be more than approximately 12 μm.

Figure 4:
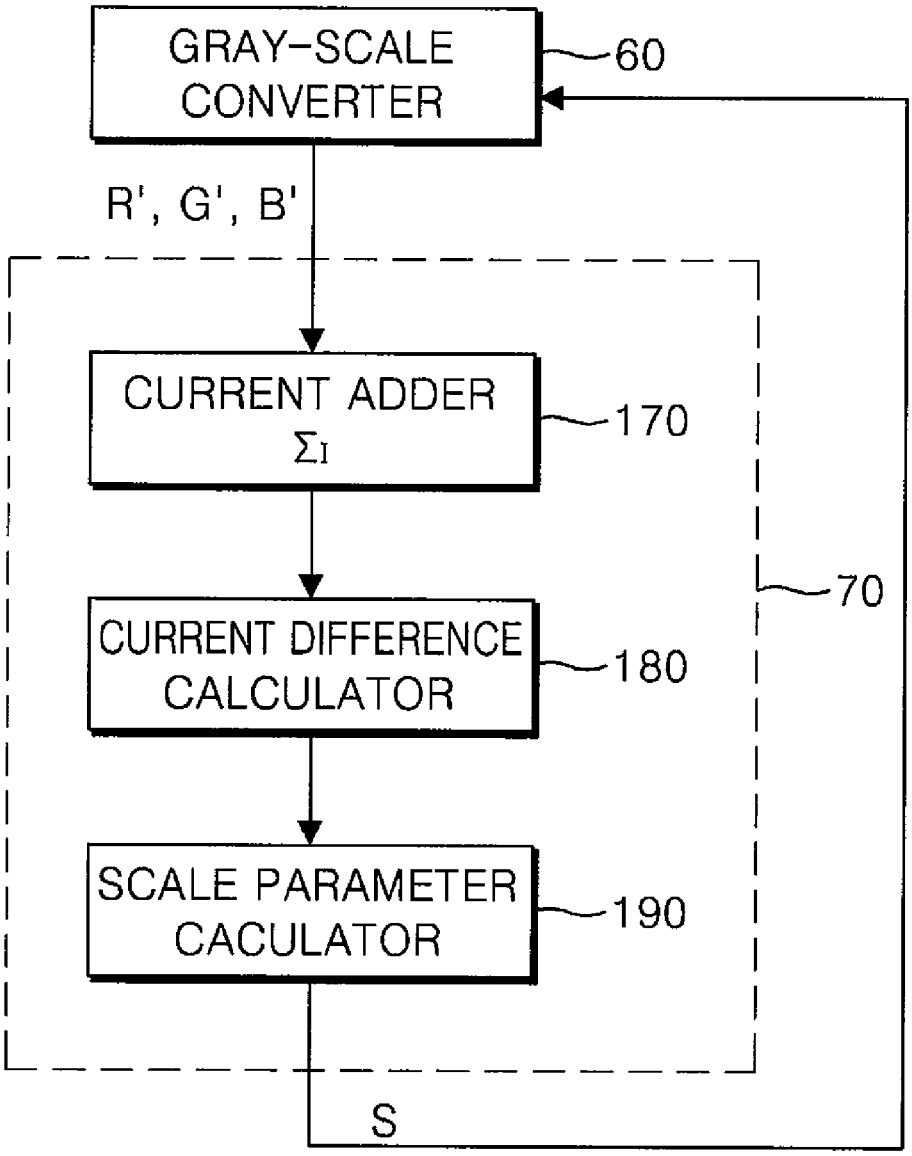
FIG. 4 is a block diagram illustrating a scale parameter generator shown in FIG. 1 according to an exemplary embodiment.

FIG. 4 is a block diagram illustrating the scale parameter generator 70 according to an exemplary embodiment.

Referring to FIG. 4, the scale parameter generator 70 includes a current adder 170, a current difference calculator 180, and a scale parameter calculator 190.

The current adder 170 sums consumption current from the data signals R', G' and B' converted by the gray-scale converter 60 to obtain a total current value ΣI. The current adder 170 calculates the total current value ΣI consumed in the OLED panel 10 by using the following Equation 1 or Equation 2. For example, one pixel includes pixel cells 80 of red, green and blue, and each pixel cell 80 includes one organic light-emitting diode. The total current value ΣI consumed in the pixel cells 80 of the OLED panel 10 can be calculated from gray-scale information of the pixel cells 80 by using Equation 1:

$$\Sigma I = R^{\gamma} + G^{\gamma} + B^{\gamma} \quad \text{[Equation 1]}$$

where γ is a constant having the range of approximately 1.8 to 3.

$$\Sigma I = \Gamma(R) + \Gamma(G) + \Gamma(B) \quad \text{[Equation 2]}$$

In the OLED panel 10, it may be difficult to calculate the amount of current when the constant γ includes a value other than an integer, for example, such as 2.2. Also, a gamma curve may be not driven exactly according to an exponential function when black and white gray scales are implemented by the OLED panel 10.

For this reason, the total current value ΣI consumed in the OLED panel 10 may be calculated by a sum of gamma functions Γ(X) showing gamma characteristics of the OLED panel 10 by using Equation 2.

The current difference calculator 180 calculates a current difference obtained by subtracting a reference current value from the total current value ΣI and supplies the current difference to the scale parameter calculator 190. The current difference calculator 180 extracts 6-bit or 8-bit data from the total current value ΣI which is digitally converted from the current adder 170. When the digitally converted value includes a binary data value exceeding 6 bits or 8 bits, the current difference calculator 180 extracts 6 or 8 most significant bits. The current difference calculator 180 then converts the binary data value of 6 or 8 bits into a decimal system. Thereafter, the current difference calculator 180 calculates a current difference between the total current value ΣI and the reference current value and supplies the difference value to the scale parameter calculator 190.

The current difference varies nonlinearly since a gray-scale conversion ratio in each frame becomes different. That is, since the total current value ΣI is obtained by multiplying the pixel data signal of a present frame by the scale parameter of a previous frame, the total current value ΣI varies nonlinearly according to the scale parameter of the previous frame and the current difference also varies nonlinearly.

The reference current value ΣIre includes a value between approximately 15% and approximately 80% of the maximum current value to be supplied to the OLED panel 10.

The scale parameter calculator 190 generates the scale parameter S by Equation 3:

$$S \le S' + \frac{\alpha\Delta}{N} \quad \text{[Equation 3]}$$

$$\Delta = \Sigma I - \Sigma Ire,$$

where S' is the scale parameter of a previous frame, α is a constant having a negative value, and Δ is a current difference obtained by subtracting the reference current value ΣIre from the total current value ΣI.

In Equation 3, α is a constant having an absolute value less than 1. For convenience of calculation, if the total current value ΣI of the OLED panel 10 is a very large number, it is necessary to reduce the constant α. The current difference Δ is not arbitrarily reduced and the constant α is set such that the current difference Δ can be divided by a value less than N according to resolution.

According to an exemplary embodiment, N is set to a positive integer greater than 1, for example, a value between 32 and 1024. When N is less than 32, the scale parameter S is changed to a very large value for each frame, and it affects display quality. When N is greater than 1024, a variation of the scale parameter is very small so that it is difficult to sufficiently control the amount of current of the OLED panel 10. Therefore, N may be set to between 32 and 1024. According to an exemplary embodiment, N is set to 256. The scale parameter S is a value between 0 and 1. Therefore, the scale parameter S varies steadily, so that a sudden change of brightness of the OLED panel 10 and display inferiority such as flickering may be prevented.

When the total current value ΣI of input frame data is equal to the reference current value ΣIre, the current difference Δ is 0, and thus, the scale parameter calculator 190 outputs the scale parameter S that is the same as the scale parameter S' of a previous frame.

When the total current value ΣI is greater than the reference current value ΣIre, the scale parameter S having a greater value than the scale parameter S' by (αΔ)/N is generated from the scale parameter calculator 190. Therefore, when the pixel data signal is rapidly changed from a low gray-scale to a high gray-scale, since the current difference Δ between the total current value ΣI and the reference current value ΣIre is large, it is possible to rapidly reduce the total current amount supplied to the OLED panel 10 so that the pixel data signal of the high gray-scale can be approximated to the reference current value ΣIre.

Figure 5:
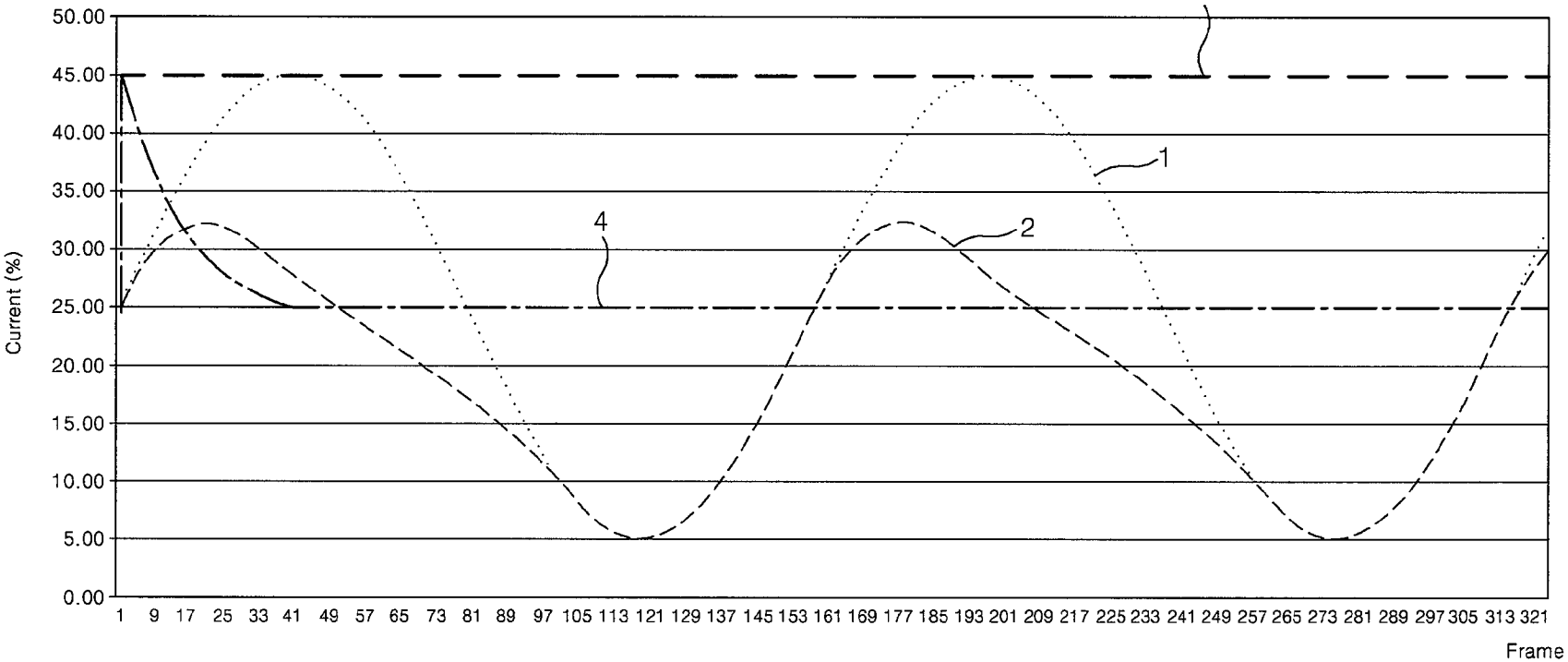
FIG. 5 is a graph illustrating a total current value which is multiplied by a scale parameter and applied to an OLED panel when a pixel data signal is applied from an external unit.

FIG. 5 illustrates a simulation graph for current consumption in each frame. If a pixel data signal designated by line '1' is input from an external unit, the pixel data signal is changed to line '2' according to the reference current value ΣIre set by the scale parameter generator 70. When a total sum of current of the pixel data signal input from the external unit shows a sine function form having 5% to 45% of the maximum current supplied to the OLED panel 10, the pixel data signal converted by the scale parameter generator 70 is as the line '2'. That is, when the total current value ΣI is greater than the reference current value ΣIre, the scale parameter S is gradually lowered to change the gray-scale of the pixel data signal input with a great width and the changed gray-scale is supplied to the OLED panel 10. The total sum of current supplied to the OLED panel 10 is controlled to have a value less than the reference current value ΣIre around the $50^{th}$ frame.

When the total current value ΣI is less than the reference current value ΣIre, the scale parameter S' of a previous frame is gradually increased to supply a scale parameter greater than the scale parameter S multiplied in the previous frame to the scale converter 60. Therefore, around the $97^{th}$ frame, the total sum of current of the input pixel data signal is the same as the total sum of current supplied to the OLED panel 10.

If a pixel data signal designated by line '3' is input from the external unit, the pixel data signal is changed to line '4' according to the reference current value ΣIre set by the scale parameter generator 70. When the pixel data signal input from the external unit keeps a constant value, for example, 45% of the maximum current supplied to the OLED panel 10, the scale parameter generator 70 generates the scale parameter S to rapidly change the pixel data signal to the reference value ΣIre. The pixel data signal is changed to have the reference current value ΣIre around the $40^{th}$ frame as in line '4'. Even though the total sum of the pixel data signal after the $40^{th}$ frame is 45% of the maximum current, the total sum of the current of the pixel data signal supplied to the OLED panel 10 is limited to 25% of the maximum current.

Therefore, the OLED device according to an exemplary embodiment rapidly changes the total sum of current of the input pixel data signal in response to the set reference current value.

Meanwhile, the scale parameter S may unnecessarily fluctuate and vary in every frame when the total current value ΣIre is at a boundary of the reference current value ΣIre and when noise exists on the OLED panel 10. If the scale parameter S varies up and down on the basis of the reference current value ΣIre, an operation may be unstable in case of an artificially generated moving picture. To prevent this phenomenon, the reference current value ΣIre is divided into an upper reference current value ΣIre,U and a lower reference current value ΣIre,L. When the total current value ΣI is between the upper reference current value ΣIre,U and the lower reference current value ΣIre,L, the scale parameter S is fixed to the scale parameter S' of the previous frame, thereby preventing the scale parameter S from changing unnecessarily.

Figure 6:
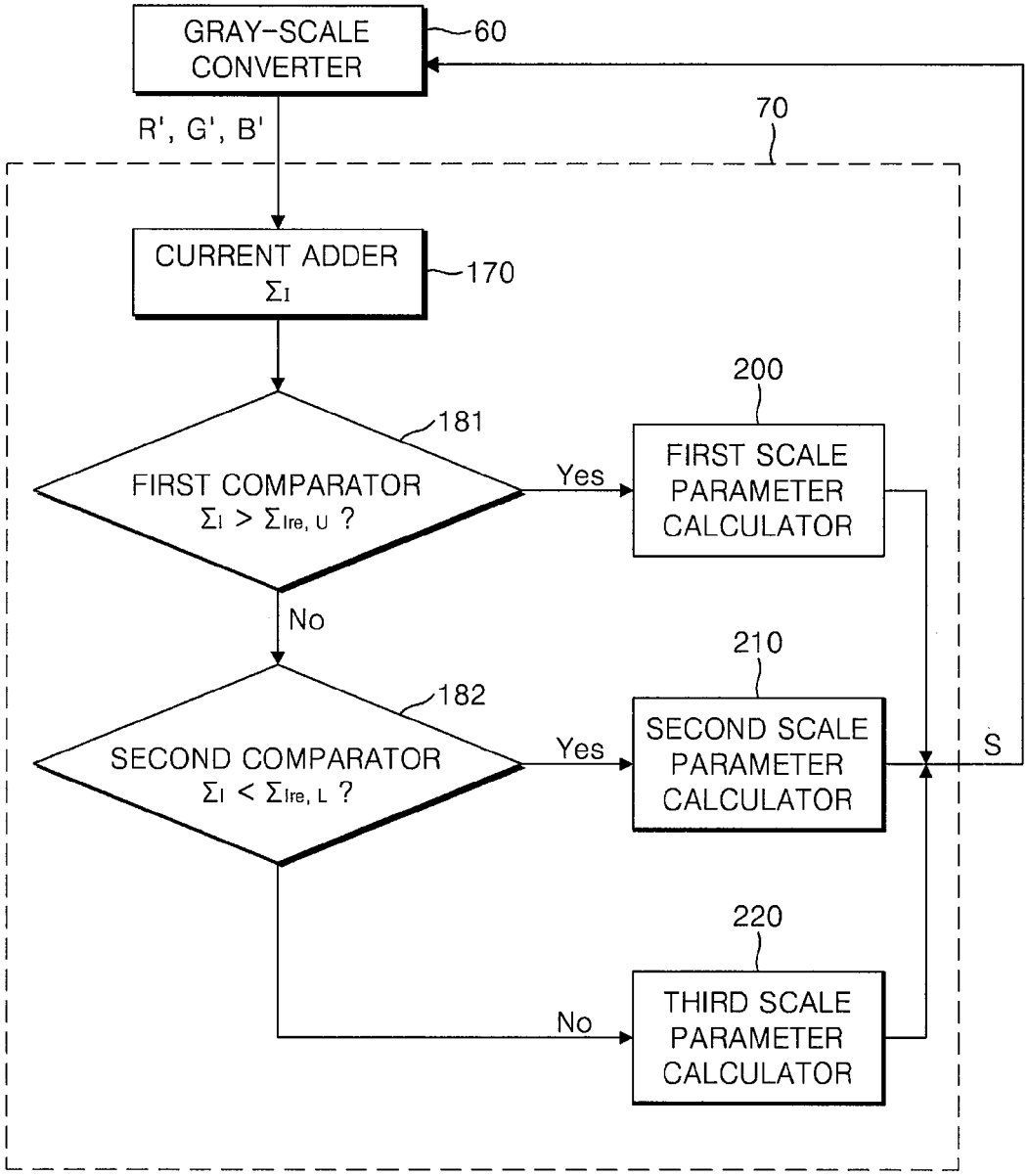
FIG. 6 is a block diagram illustrating a scale parameter generator shown in FIG. 1 according to another exemplary embodiment.

FIG. 6 is a block diagram illustrating the scale parameter generator 70 according to another exemplary embodiment.

Referring to FIG. 6, the scale parameter generator 70 includes a current adder 170, first and second current comparators 181 and 182, and first, second, and third scale parameter calculators 200, 210, and 220.

The first comparator 181 of the scale parameter generator 70 compares the total current value ΣI inputted from the current adder 170 with an upper reference current value ΣIre, U.

When the total current value ΣI is greater than the upper reference current value ΣIre,U, the first scale parameter calculator 200 outputs the scale parameter S by using Equation 3. However, when the total current value ΣI is not greater than the upper reference current value ΣIre,U, the second comparator 182 compares the total current value ΣI with the lower reference current value ΣIre,L.

When the total current value ΣI is less than the lower reference current value ΣIth,L, the second scale parameter calculator 210 outputs the scale parameter S by using Equation 3. On the other hand, when the total current value ΣI is not less than the lower reference current value ΣIre,L, the third scale parameter calculator 220 outputs the scale parameter S' of the previous frame.

The scale parameter generator 70 supplies the scale parameter S' of the previous frame to the gray-scale converter 60 when the inputted total current value ΣI is between the upper reference current value ΣIth,U and the lower reference current value ΣIth,L. Therefore, it is possible to prevent the scale parameter S from changing unnecessarily.

In an exemplary embodiment, the upper reference current value ΣIth,U is set to a value which is approximately 20% greater than the reference current value ΣIre, and the lower reference current value ΣIth,L is set to a value which is approximately 20% less than the reference current value ΣIre. The upper and lower reference current values ΣIth,U and ΣIth,U may be set according to the amplitude of a noise component of the OLED panel 10.

The first and second comparators 181 and 182 and the first, second and third scale parameter calculator 200, 210 and 220 may be realized by an operator of a single processor or a block of a software program.

According to an exemplary embodiment, the OLED device limits current supplied to the OLED panel 10 to be rapidly approximated to the reference current value ΣIre when the total current value ΣI is greater than the reference current value ΣIre, thereby reducing the line width of each of the first and second current-supply lines PL1 and PL2. The amount of current supplied from the power supply 40 to the first and second current-supply lines PL1 and PL2 is decreased to reduce the power consumption of the OLED panel 10. Also, since the line width of each of the first and second current-supply lines PL1 and PL2 is reduced, an aperture ratio is increased, and since the amount of current supplied to the OLED panel 10 is reduced, lifespan of the OLED device is increased.

Figure 7:
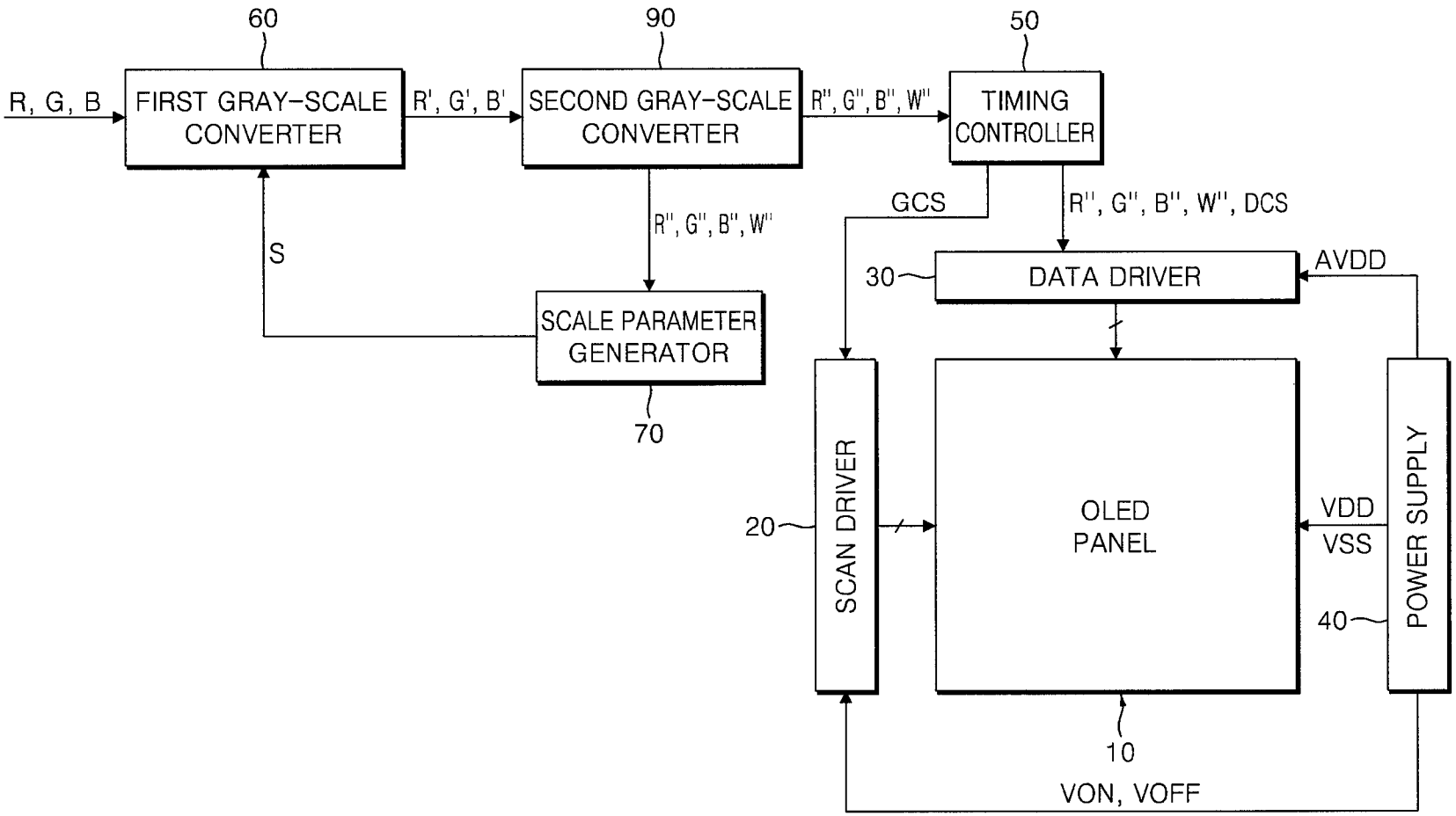
FIG. 7 is a block diagram illustrating an OLED device according to another exemplary embodiment.

FIG. 7 is a block diagram illustrating an OLED device according to another exemplary embodiment.

The OLED device of FIG. 7 has the same configuration as that of FIG. 1, except that the OLED device of FIG. 7 further includes a second gray-scale converter 90 which converts pixel data signals R', G∝0 and B' of red, green and blue into pixel data signals R", G", B" and W" of red, green, blue and white. Therefore, a description of repetitive elements will be omitted.

Referring to FIG. 7, the OLED device includes an OLED panel 10, a scan driver 20, a data driver 30, first and second gray-scale converters 60 and 90, a timing controller 50, and a scale parameter generator 70.

More specifically, the second gray-scale converter 90 converts the pixel data signals R', G' and B' of red, green and blue into pixel data signals R", G", B" and W" of red, green, blue and white. The pixel data signals R", G", B" and W" supplied from the second gray-scale converter 90 are supplied to the timing controller 50 and the scale parameter generator 70.

The timing controller 50 supplies the pixel data signals R", G", B" and W" supplied from the second gray-scale converter 90 to the data driver 30 according to a data control signal DCS.

The scale parameter generator 70 calculates a total current value ΣI of the pixel data signals R", G", B" and W" of red, green, blue and white supplied from the second gray-scale converter 90 to generate a scale parameter S and supplies the scale parameter S to the first gray-scale converter 60.

The scale parameter generator 70 includes the current adder 170, the current difference calculator 180 and the scale parameter calculator 190, as shown in FIG. 4. The current adder 170 of the scale parameter generator 70 calculates the total current value ΣI of the OLED panel 10 by using Equation 4 or Equation 5. Equation 4 and Equation 5 additionally have parameters for a white pixel data signal W" compared to Equation 1 and Equation 2, and thus duplicated descriptions are omitted.

$$\Sigma I = R^{\gamma} + G^{\gamma} + B^{\gamma} + W^{\gamma} \quad \text{[Equation 4]}$$

$$\Sigma I = \Gamma(R) + \Gamma(G) + \Gamma(B) + \Gamma(W) \quad \text{[Equation 5]}$$

A description of the current adder, the current difference calculator and the scale parameter calculators will be omitted.

The OLED devices according to the exemplary embodiments include low current consumption and an improved aperture ratio as shown in Table 1 below.

Table 1 illustrates a maximum supply current to be supplied from the power supply 40, the line width of each of the first and second current-supply lines PL1 and PL2, a ratio (%)

of the display area size of the OLED panel 10 to the area size of the first and second current-supply lines PL1 and PL2, an aperture ratio (%), and a lifespan improvement (%) which are obtained when the reference current value ΣIre is changed to a value of approximately 15% to approximately 100% of the maximum consumption current.

TABLE 1

| Reference current value (%) | Maximum supply current (A) | Line width of PL1 and PL2 (μm) | Area ratio of PL1 and PL2 (%) | Aperture ratio (%) | Lifespan improvement (%) |
|---|---|---|---|---|---|
| 100 | 12.5 | 83 | 16.3 | 43 | 0 |
| 80 | 10 | 66.4 | 13.0 | 46.3 | 16 |
| 50 | 6.25 | 41.5 | 8.1 | 51.1 | 41 |
| 25 | 3.125 | 20.75 | 4.1 | 55.4 | 65 |
| 15 | 1.875 | 12.45 | 2.4 | 56.8 | 75 |

Referring to Table 1, when the reference current value ΣIre is restricted to 80% of the total consumption current of the OLED panel 10, the maximum supply current is 10A, whereby the line width of each of the first and second current-supply lines PL1 and PL2 is reduced from 83 μm to 66.4 μm. As a result, the area ratio that the first and second current-supply lines PL1 and PL2 occupies in the OLED panel 10 is reduced from 16.3% to 13%, whereby the aperture ratio is increased from 43% to 46.3%.

The lifespan can be improved about 16% by restricting the current supplied to the organic light-emitting diode. Here, if the reference current value ΣIre is equal to or more than 80% of the maximum consumption current, the maximum supply current supplied from the power supply 40 to the first and second current-supply lines PL1 and PL2 is equal to or more than 10 A, so that the effect of the aperture ratio and lifespan improvement is not large since the line width of each of the first and second current-supply lines PL1 and PL2 is increased. Therefore, in the exemplary embodiment, the reference current value ΣIre is equal to or less than 80% of the total consumption current of the OLED panel 10.

When the reference current value is restricted to 15% of the total consumption current, the maximum supply current is 1.875 A, whereby the line width of each of the first and second current-supply lines PL1 and PL2 is reduced from 83 μm to 12.45 μm. As a result, the area ratio that the first and second current-supply lines PL1 and PL2 occupies in the OLED panel 10 is reduced from 16.3% to 2.4%, whereby the aperture ratio is increased from 43% to 56.8%.

The lifespan can be improved about 75% by restricting the reference current value ΣIre of the OLED panel 10. Therefore, since the amount of current used in the OLED panel 10 is reduced, the power consumption is reduced. However, if the reference current value ΣIre is lowered to less than 15% of the maximum consumption current, current supplied to the first and second current-supply lines PL1 and PL2 is so small that the whole brightness of the OLED panel 10 is reduced. Therefore, according to the exemplary embodiment, the reference current value is set to a value between 15% and 80% of the total consumption current of the OLED panel 10.

As described above, according to an exemplary embodiment, current supplied to the OLED panel is restricted to the reference current value ΣIre which is in a range of 15% to 80% of the maximum consumption current of the OLED panel, thereby reducing the line width of the current-supply line which supplies a driving voltage of the organic light-emitting diode and improving the aperture ratio. Also, since the line width of the current-supply line is reduced, the contact area size between the current-supply line and the circuit board is reduced, whereby the process for contacting the current-supply line and the circuit board is simplified, leading to a low manufacturing cost.

Furthermore, since current used in the OLED panel is reduced, the power consumption is low. In addition, since the amount of current supplied to the organic light-emitting diode is reduced, the calorific value of the organic light-emitting diode is reduced, thereby improving the lifespan.

Since the scale parameter is calculated by the current difference between the total current value and the reference current value, the scale parameter is rapidly changed and thus the total current value can be rapidly changed to the reference current value.

While the subject matter disclosed herein has been shown and described with reference to some exemplary embodiments, it should be understood by those of ordinary skill in the art that various changes in form and details may be made therein without departing from the spirit and the scope of the disclosure as defined in the appending claims.

What is claimed is:

1. An organic light-emitting display device, comprising:

an organic light-emitting display panel having pixel cells formed thereon;

a gray-scale converter configured to convert a gray-scale of a pixel data signal by multiplying the pixel data signal that drives the pixel cells by a scale parameter; and a scale parameter generator configured to generate the scale parameter, wherein the scale parameter generator generates a scale parameter of a present frame by increasing or decreasing a scale parameter of a previous frame in proportion to a current difference obtained by subtracting a reference current value from a total current value of the pixel data signal which is gray-scale converted from the previous frame.

2. The organic light-emitting display device of claim 1, wherein the scale parameter generator comprises:

a current adder which calculates the total current value of the pixel data signal gray-scale converted from the previous frame;

a current difference calculator which calculates the current difference; and a scale parameter calculator which adds a negative constant multiplied by a prescribed value to the scale parameter of the previous frame, wherein the prescribed value is obtained by dividing the current difference by N (where N is an integer greater than 1).

3. The organic light-emitting display device of claim 2, wherein the scale parameter is greater than 0 and less than 1.

4. The organic light-emitting display device of claim 3, wherein the reference current value comprises a value of approximately 15% to approximately 80% of a maximum current amount consumed in the organic light-emitting display panel.

5. The organic light-emitting display device of claim 1, wherein the scale parameter generator comprises:

a current adder which calculates the total current value of the pixel data signal gray-scale converted from the previous frame;

a first comparator which compares the total current value with an upper reference current value greater than the reference current value at a boundary of the reference current value;

a second comparator which compares the total current value with a lower reference current value less than the reference current value at a boundary of the reference current value;

a first scale parameter calculator which supplies to the gray-scale converter a scale parameter having a less value than a scale parameter of the previous frame when the total current value is greater than the upper reference current value;

a second scale parameter calculator which supplies to the gray-scale converter a scale parameter having a greater value than a scale parameter of the previous frame when the total current value is less than the lower reference current value; and a third scale parameter output portion which supplies to the gray-scale converter a scale parameter of the previous frame when the total current value is between the upper reference current value and the lower reference current value.

6. The organic light-emitting display device of claim 5, wherein the upper and lower reference current values comprise values within approximately 20% of the reference current value.

7. The organic light-emitting display device of claim 1, wherein the organic light-emitting display panel includes pixel cells of red, green, blue, and white, and the gray-scale converter further comprises a second gray-scale converter which converts pixel data signals of red, green, and blue into pixel data signals of red, green, blue, and white.

8. The organic light-emitting display device of claim 7, wherein the scale parameter generator generates the scale parameter corresponding to a current difference between by comparing the reference current value with a total current sum calculated from the pixel data signal of red, green, blue and white by the second gray-scale converter.

9. The organic light-emitting display device of claim 1, wherein the organic light-emitting display panel further comprises first and second current supply lines which cross each other to supply current to the pixel cells and are electrically connected to each other at a crossing point.

10. The organic light-emitting display device of claim 9, further comprising:

a gate driver and a data driver which drive the organic light-emitting display panel;

a timing controller which supplies control signals to the gate driver and the data driver and supplies the pixel data signal inputted from the gray-scale converter to the data driver; and a power supply which supplies power to the first and second current supply lines.

11. The organic light-emitting display device of claim 10, wherein a line width of each of the first and second current-supply lines comprises a range of approximately 12 μm to approximately 67 μm.

12. A method for driving an organic light-emitting display device, the method comprising:

calculating a current difference by subtracting a reference current value from a total current value of pixel data signals supplied to an organic light-emitting display panel of a previous frame;

generating a scale parameter of a present frame by increasing and decreasing a scale parameter multiplied by the pixel data signals supplied from the previous frame in proportion to the current difference; and multiplying the scale parameter by the pixel data signals of the present frame.

13. The method of claim 12, wherein the step of generating the scale parameter further comprises:

multiplying a value obtained by dividing the current difference by N (where N is an integer greater than) by a negative constant; and adding the scale parameter of the previous frame to a value generated in the step of multiplying the value.

14. The method of claim 13, wherein the step of calculating the current difference further comprises setting the reference current value to a value between approximately 15% and 80% of a maximum consumption current of the organic light-emitting display panel.

15. The method of claim 14, wherein the step of setting the reference current value further comprises:

setting an upper reference current value greater than the reference current value and a lower reference current value less than the reference current value;

comparing the total current value with the upper and lower reference current values; and generating the scale parameter of the previous frame when the total current value is between the upper and lower reference current values.

16. The method of claim 15, wherein the step of comparing the total sum with the upper and lower reference current values further comprises:

generating a scale parameter by decreasing the scale parameter of the previous frame according to the current difference when the total current value is greater than the upper reference current value; and generating a scale parameter by increasing the scale parameter of the previous frame according to the current difference when the total current value is less than the lower reference current value.

17. The method of claim 16, wherein the step of setting the upper reference current value and the lower reference current value further comprises:

setting the upper reference current value to a value greater than the reference current value within 20% of the reference current value and the lower reference current value to a value less than the reference current value within 20% of the reference current value.

18. The method of claim 12, wherein, before the step of multiplying the scale parameter, further comprises:

converting a gray-scale by multiplying the pixel data signals of the present frame by the scale parameter; and converting the gray-scale converted pixel data signals into pixel data signals of red, green, blue, and white.

* * * * *